US008025422B1

(12) United States Patent
Huang et al.

(10) Patent No.: US 8,025,422 B1
(45) Date of Patent: Sep. 27, 2011

(54) ILLUMINATION DEVICE WITH REFLECTORS

(75) Inventors: Xing-Gui Huang, Shenzhen (CN); Jia-Chuan Lv, Shenzhen (CN); Chin-Chung Chen, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 12/849,763

(22) Filed: Aug. 3, 2010

(30) Foreign Application Priority Data

May 28, 2010 (CN) ..... 2010 1 0186083

(51) Int. Cl.
*F21V 1/00* (2006.01)

(52) U.S. Cl. .. 362/241; 362/97.3; 362/294; 362/296.01; 362/373; 362/609; 362/613; 362/632

(58) Field of Classification Search ..... 362/97.1–97.3, 362/227, 234–235, 241, 296.01, 609, 612–613, 362/632–634, 294, 373
See application file for complete search history.

(56) References Cited

U.S. PATENT DOCUMENTS

| | | | | |
|---|---|---|---|---|
| 6,250,774 | B1 * | 6/2001 | Begemann et al. | 362/231 |
| 2009/0046457 | A1 * | 2/2009 | Everhart | 362/235 |
| 2010/0110660 | A1 * | 5/2010 | Brukilacchio | 362/84 |

* cited by examiner

*Primary Examiner* — Stephen F Husar
*Assistant Examiner* — Meghan Dunwiddie
(74) *Attorney, Agent, or Firm* — Altis Law Group, Inc.

(57) ABSTRACT

An exemplary illumination device includes a heat sink, a plurality of LED modules mounted on the heat sink, an envelope engaged with the heat sink and covering the LED modules, and a reflector positioned on the envelope. Light generated by the LED modules emits forward through the envelope out of the illumination device and has a main emission direction. The reflector reflects the light back to a direction sideways and opposite to the main emission direction to increase an illumination area.

12 Claims, 4 Drawing Sheets

ILLUMINATION DEVICE WITH REFLECTORS

BACKGROUND

1. Technical Field

The present disclosure relates generally to illumination devices, and more particularly to an illumination device for use with solid state light emitters, e.g., light emitting diodes (LEDs).

2. Description of Related Art

LEDs as a source of illumination provide advantages such as resistance to shock and nearly limitless lifetime under specific conditions. Thus, illumination devices utilizing LEDs present a cost-effective yet high quality replacement for incandescent and fluorescent lamps.

Conventional lamps such as incandescent lamps can emit light radially and illuminate all around the lamps. However, LEDs are area light sources and the light emitted by the LEDs is of high directivity. Lamps using LEDs as light sources can not illuminate rear directions thereof, which is not convenient for the users, especially when the lamps are applied in mines or tunnels.

What is needed therefore is an illumination device having reflectors which can overcome the above limitations.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the views.

DETAILED DESCRIPTION

Figure 1:
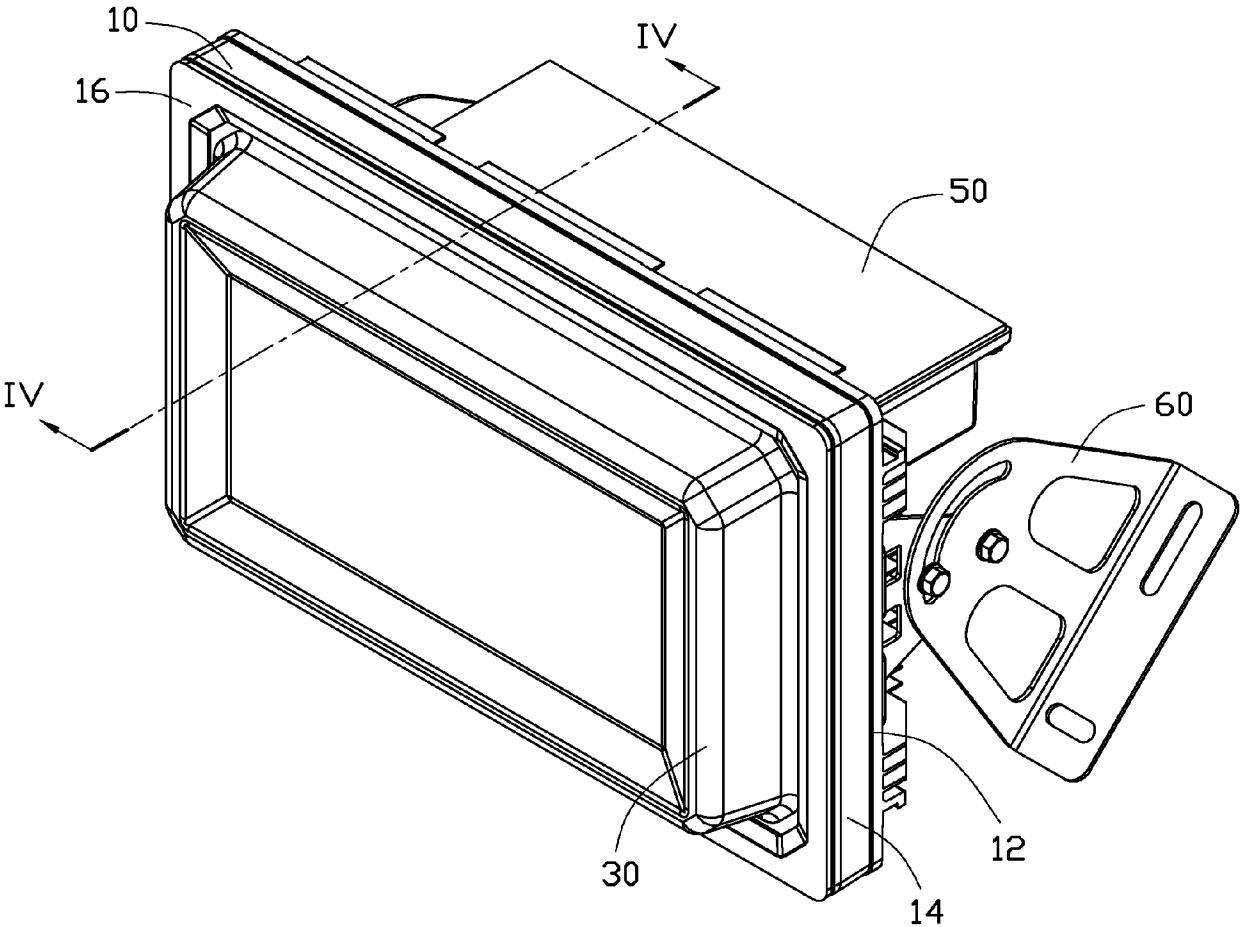
FIG. 1 is an isometric, assembled view of an illumination device in accordance with an embodiment of the present disclosure.
Figure 2:
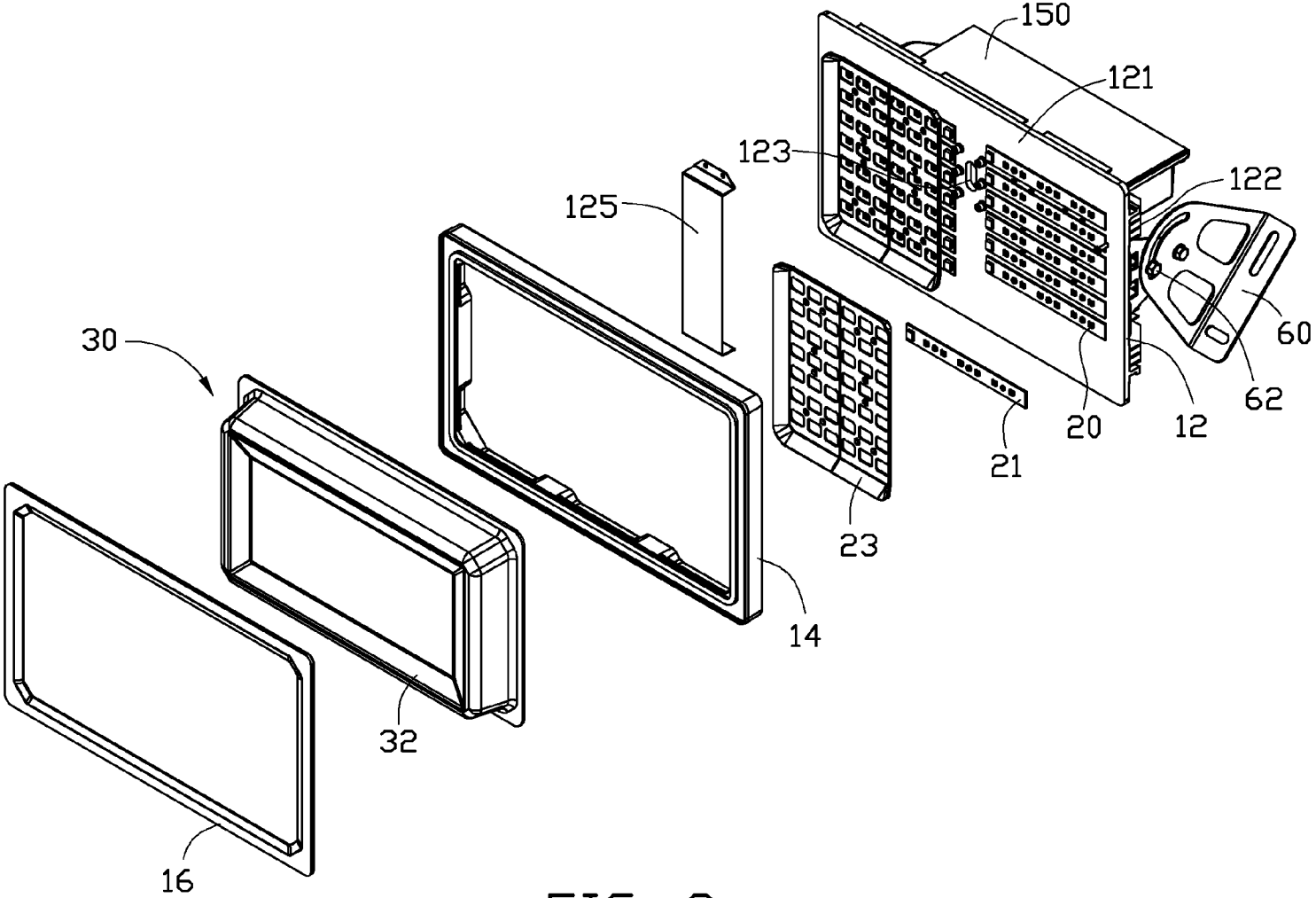
FIG. 2 is an isometric, exploded view of the illumination device in FIG. 1.
Figure 4:
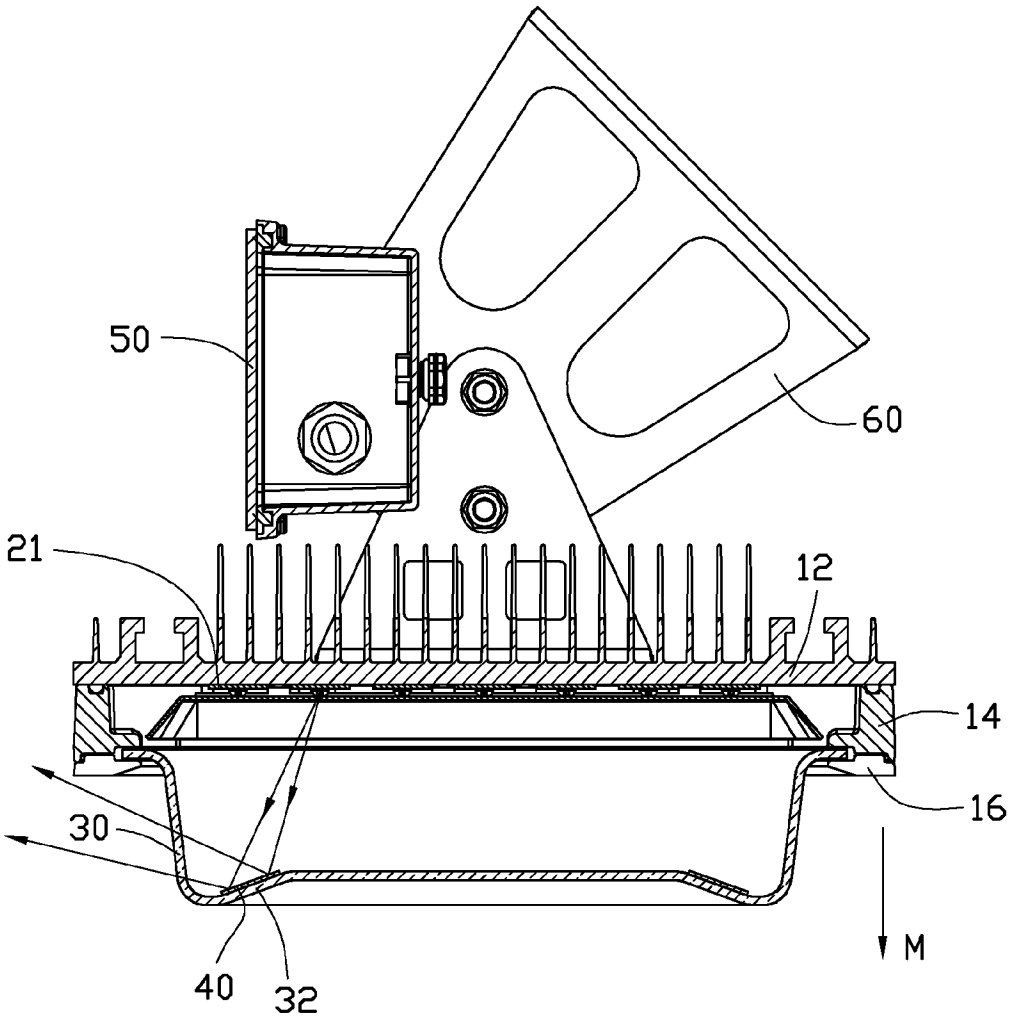
FIG. 4 is a cross sectional view of the illumination device in FIG. 1, taken along line IV-IV thereof.

Referring to FIGS. 1, 2 and 4, an illumination device in accordance with an embodiment of the present disclosure comprises a housing 10, a light source 20 accommodated in the housing 10, and an envelope 30 engaged with the housing 10 and covering the light source 20. Light generated by the light source 20 emits through the envelope 30 and has a main emission direction M. A reflector 40 is mounted on the envelope 30. The reflector 40 can reflect the light to a direction deflected from the main emission direction M in a sideways and opposite manner.

The housing 10 comprises a heat sink 12. The heat sink 12 comprises a base 121 and a plurality of fins 122 extending from a surface of the base 121. The light source 20 is mounted on another surface of the base 121 opposite to the fins 122. The base 121 is a substantially rectangular metal plate, and the surface on which the light source 20 is mounted is flattened. It is understood that, in alternative embodiments, the base 121 can be other shapes such as circular and square, and the surface can be curved, or have posts, plates or other similar structures formed thereon for mounting the light source 20.

In some embodiments, the envelope 30 can engage with the heat sink 12 directly. In the present embodiment, the housing 10 further comprises a frame 14 mounted on the heat sink 12. The envelope 30 engages with the frame 14 of the housing 10. Specifically, the frame 14 surrounds the light source 20 and has a predetermined height along the main emission direction M to define a receiving room (not labeled) therein. The housing 10 further comprises a pressing collar 16 depressing edges of the envelope 14 on the frame 14 to secure the envelope 30 onto the frame 14.

The light source 20 comprises a plurality of LED modules 21. In other embodiments, the light source 20 could comprise other light emitters such as laser diodes or organic light emitting diodes. The LED modules 21 are mounted on the base 121 of the heat sink 12 and face the envelope 30.

Two decorating plates 23 are mounted on the LED modules 21 and received in the receiving room of the frame 14. The decorating plates 23 can hide portions of the LED modules 21 which do not emit light for aesthetic purpose. The decorating plates 23 can also extend around the LED modules 21 to function as a reflecting plate.

A power module 50 is assembled on the heat sink 12 and over the fins 122 to provide electrical power for the LED modules 21. Specifically, a hole 123 is defined in the base 121 for lead wires (not shown) extending therethrough to electrically connect to the power module 50 and the LED modules 21. A shield plate 125 covers the hole 123 to protect the lead wires and other elements. The shield plate 125 is positioned between the LED modules 21 to divide the LED modules 21 into two separated parts.

Two supporting racks 60 are respectively positioned on two ends of the base 121 of the heat sink 12 for mounting the illumination device on an object such as a pole or a wall. Each of the supporting racks 60 further comprises a positioning structure 62, which is used to adjust the relative position of the supporting racks 60 and the housing 10. By the positioning structure 62, the orientation of the LED modules 21 and according the illuminating direction of the illumination device can be adjusted.

Figure 3:
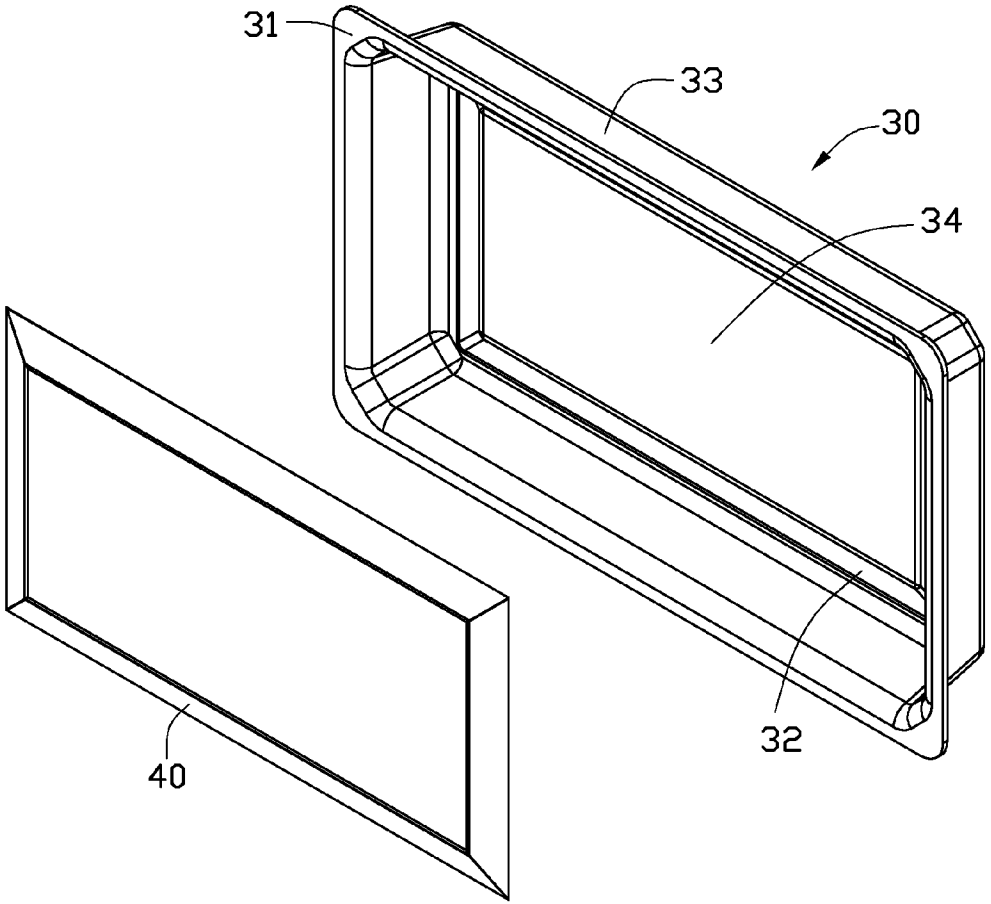
FIG. 3 is an isometric, exploded view of an envelope and a reflector of the illumination device in FIG. 1.

Referring to FIG. 3, the envelope 30 is made of transparent or translucent material such as glass or resin. The envelope 30 is configured to have a shape of a rectangular casing. The envelope 30 comprises an opened engaging portion 31, a side wall 33 extending downwardly from the engaging portion 31 (also referring to FIG. 4), an inclined surface 32 extending upwardly and inwardly from a free end of the side wall 33, and a bottom surface 34 interconnecting inner edges of the inclined surface 32. The engaging portion 31 is sandwiched between the frame 14 and the pressing collar 16. The side wall 33 comprises four lateral walls connected in series to form a rectangular tube. The inclined surface 32 is angled with the main emission direction M. Corresponding to the four lateral walls of the side wall 33, the inclined surface 32 also comprises four inclined rectangular strips connected in series. The bottom surface 34 is interconnected with the inclined surface 32 and closes the bottom end of the envelope 30. The bottom surface 34 is flattened and perpendicular to the main emission direction M. The envelope 30 can be other configurations such as a round shape in an alternative embodiment. In addition, each inclined rectangular strip of the inclined surface 32 is not limited to be flattened, for example, can be a curved surface.

The reflector 40 is compliantly adhered onto the inclined surface 32. Since the inclined surface 32 is angled with the main emission direction M, the light generated by the LED modules 21 can be more efficiently reflected to the direction sideways and opposite to the main emission direction M. In the present embodiment, the reflector 40 is a thin plate made of material with high reflectivity and is adhered on an inner side of the inclined surface 32. Understandably, the reflector 40 can also be a reflective layer painted on the inclined surface 32.

As shown in FIG. 4, the light generated by the LED modules 21 can emit forward through the envelope 30 and have the main emission direction M identical to the direction of gravity when the LED modules 21 face toward the ground. The light can be reflected to a lateral and rear direction sideways and opposite to the main emission direction M by the reflection of the reflector 40 on the envelope 30, to illuminate the wall or the pole on which the supporting racks 60 are mounted. Thus, a larger illumination area is obtained.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. An illumination device comprising:

a housing;

a light source accommodated in the housing;

an envelope engaged with the housing and covering the light source, light generated by the light source emitting through the envelope out of the illumination device and having a main emission direction; and a reflector positioned on the envelope to reflect the light to a direction sideways and opposite to the main emission directions;

wherein the housing comprises a heat sink, a frame engaged with the heat sink and the envelope, and a pressing collar pressing the envelope to the frame, the light source being surrounded by the frame.

2. The illumination device of claim 1, wherein the envelope comprises an inclined surface angled with the main emission direction, the reflector being mounted on the inclined surface.

3. The illumination device of claim 1, wherein the light source comprises a plurality of light emitting diode (LED) modules.

4. An illumination device comprising:

a heat sink;

a plurality of LED modules mounted on the heat sink;

at least one supporting rack positioned on the heat sink and opposite to the LED modules, a positioning structure being formed on the at least one supporting rack and capable of adjusting orientation of the LED modules;

an envelope engaged with the heat sink and covering the LED modules, light generated by the LED modules emitting forward through the envelope out of the illumination device and having a main emission direction; and a reflector positioned on the envelope to reflect the light back to a direction sideways and opposite to the main emission direction.

5. The illumination device of claim 4, wherein the envelope comprises an inclined surface angled with the main emission direction, the reflector being mounted on the inclined surface.

6. The illumination device of claim 5, wherein the envelope further comprises an engaging portion, a side wall extending from the engaging portion, and a bottom surface, the inclined surface interconnecting with the side wall and the bottom surface.

7. The illumination device of claim 4, further comprising a frame sandwiched between the envelope and the heat sink, the LED modules being surrounded by the frame.

8. The illumination device of claim 7, further comprising a plurality of decorating plates received in the frame and covering portions of the LED modules.

9. The illumination device of claim 4, further comprising a power module positioned on the heat sink and opposite to the LED modules, a hole being defined in the heat sink adapted for lead wires extending therethrough to electrically connect to the power module and the LED modules.

10. The illumination device of claim 9, further comprising a shield plate positioned on the heat sink adapted for covering the lead wires, the shield plate being positioned between the LED modules to divide the LED modules into two separated parts.

11. An illumination device comprising:

a heat sink;

a plurality of LED modules mounted on the heat sink;

an envelope engaged with the heat sink and covering the LED modules, light generated by the LED modules emitting forward through the envelope out of the illumination device and having a main emission direction;

a reflector positioned on the envelope to reflect the light back to a direction sideways and opposite to the main emission direction;

a frame sandwiched between the envelope and the heat sink, the LED modules being surrounded by the frame; and a plurality of decorating plates received in the frame and covering portions of the LED modules.

12. An illumination device comprising:

a heat sink;

a plurality of LED modules mounted on the heat sink;

an envelope engaged with the heat sink and covering the LED modules, light generated by the LED modules emitting forward through the envelope out of the illumination device and having a main emission direction;

a reflector positioned on the envelope to reflect the light back to a direction sideways and opposite to the main emission direction;

a power module positioned on the heat sink and opposite to the LED modules, a hole being defined in the heat sink adapted for lead wires extending therethrough to electrically connect to the power module and the LED modules; and a shield plate positioned on the heat sink adapted for covering the lead wires, the shield plate being positioned between the LED modules to divide the LED modules into two separated parts.

* * * * *